US005878462A

United States Patent [19]

Lindén et al.

[11] Patent Number: 5,878,462

[45] Date of Patent: Mar. 9, 1999

[54] DUST REMOVAL APPARATUS

[75] Inventors: Anders Tommy Lindén; Harry Ingemar Myrén; Lars-Erik Önnerlöv, all of Karlstad, Sweden

[73] Assignee: Valmet-Karlstad AB, Karlstad, Sweden

[21] Appl. No.: 861,400

[22] Filed: May 21, 1997

Related U.S. Application Data

[60] Provisional application No. 60/024,773 Aug. 28, 1996.

[30] Foreign Application Priority Data

May 21, 1996 [SE] Sweden ..... 9601915

[51] Int. Cl.[6] ..... D21G 9/00

[52] U.S. Cl. ..... 15/309.1; 162/272

[58] Field of Search ..... 15/306.1, 309, 15/309.1; 162/111, 272, 281

[56] References Cited

U.S. PATENT DOCUMENTS

| | | | |
|---|---|---|---|
| 2,082,411 | 6/1937 | Merrill | 15/309.1 |
| 3,775,806 | 12/1973 | Olbrant et al. . | |
| 4,019,953 | 4/1977 | Nystrom . | |
| 4,197,609 | 4/1980 | Fuhring | 15/309.1 |
| 4,269,047 | 5/1981 | Schuierer | 15/309.1 X |
| 4,906,333 | 3/1990 | Myren | 162/272 X |
| 5,007,986 | 4/1991 | Gustavsson et al. . | |
| 5,011,574 | 4/1991 | Gustavsson et al. . | |
| 5,466,298 | 11/1995 | Pollock . | |
| 5,490,300 | 2/1996 | Horn | 15/309.1 X |
| 5,577,294 | 11/1996 | Pollock . | |

FOREIGN PATENT DOCUMENTS

| | | | |
|---|---|---|---|
| 1145572 | 3/1963 | Germany | 15/309.1 |

*Primary Examiner*—Chris K. Moore
*Attorney, Agent, or Firm*—Bell Seltzer Intellectual Property Law Group of Alston & Bird LLP

[57] ABSTRACT

An apparatus for removing dust released, for instance, during the production of a soft crepe paper web which is creped off a Yankee cylinder and spread laterally. The apparatus comprises a dust suction box consisting of a housing with an inner suction chamber, said housing having a first inlet in the form of a suction gap, a main part and first and second parts which define said suction gap between them. According to the invention the main part is in the form of part of a cylinder to provide a corresponding curved inner side in the suction chamber, and the suction gap comprises an outer gradual throttling and an inner gradual enlargement, said throttling and enlargement merging at a transition where said throttling is maximal. The first inlet forming part preferably comprises a flat surface that defines its side of said enlargement whereas the second part forming the inlet comprises both a curved surface having a predetermined radius and such an arc length that it defines the whole of its side of the throttling and an initial part of the enlargement, and also an inner, flat surface extending at a tangent from the curved surface and forming an acute angle α with a tangent to the curved surface at said transition.

25 Claims, 8 Drawing Sheets

DUST REMOVAL APPARATUS

CROSS-REFERENCE TO RELATED APPLICATIONS

This application claims the benefit of U.S. Provisional Application No. 60/024,773, filed Aug. 28, 1996.

FIELD OF THE INVENTION

The present invention relates to an apparatus for removing dust released during the treatment of a moving web of fibre material such as creped paper

BACKGROUND OF THE INVENTION

Dust in the form of fibres and other particles is released from the web when creping off a soft crepe paper web, e.g. a tissue web, from a Yankee cylinder. To remove this dust it has been proposed in U.S. Pat. No. 4,019,953 (SE-381 899) to arrange a collection container below the area where the dust is produced. A compressed air pipe and a suction pipe are connected to this in order to remove dusty air drawn across the direction of transport of the web by jets of compressed air. Compressed air must be blown on since merely drawing off the dust by means of ventilation has little effect in view of poor distance action. Such a device is cumbersome, bulky and relatively inefficient since it only takes care of some of the dust falling down below the dust-producing area. The high speeds of modern tissue machines, namely in the region of near 25 m/s, contribute to the unsatisfactory result since dusty air is entrained along on both sides of the fast-moving tissue web which is delicate due to its low grammage.

The release of dust from the surface of a paper web is a problem when cutting and rewinding the paper web, for instance, U.S. Pat. No. 3,775,806 (SE-319 969) proposes an apparatus for dust-suction of the surface of a paper web. To avoid the web being drawn in towards the suction device and coming into contact with this, thus causing damage to the web, air is blown on at the same time as the suction. The proposed dust-suction device therefore comprises a horizontal sheet-metal channel, open at the top, which surrounds a rectangular blowing pipe and extends transversely across the web. The side of the blowing pipe facing the web has openings facing away from each other in order to direct air jets substantially parallel to the web both with and against the direction of transport of the web, thus fixing the distance between the web and dust suction device. Intermediate openings of the same type may be arranged to direct air jets towards the surface of the web to achieve a better dust suction effect by blowing dust off the surface. The air supplied and the dust entrained are withdrawn perpendicularly to the web, through the two gaps formed upstream and downstream of the blowing pipe, between it and the surrounding sheet-metal channel, to which a means for drawing off air is connected. The wall parts of the sheet-metal channel located nearest the web may be vertically movable up and down enabling them to be set in such a manner that the dust-carrying air blown on does not flow past the suction gaps, neither does the web scrape against said wall parts and become damaged. The dust-suction effect achieved with the arrangement according to U.S. Pat. No. 3,775,806 does not, however, fulfil modern requirements with regard to also taking care of the dust that accompanies the air around a fast-moving paper web. Furthermore, the arrangement is both bulky and expensive to purchase and to operate due to the air flows required by the blow-on technique.

U.S. Pat. No. 4,906,333 (SE-B 459 105) proposes an apparatus for removing dust in the boundary layer of a creped web. This apparatus comprises a web-wide hood and a flat cover plate that closes the hood while defining a space in which subatmospheric pressure prevails, and forming a suction gap between the cover plate and an angled strip at the front side edge of the hood. The cover plate is located immediately next to the creped web so that, during transport, it is held close to the cover plate and said suction gap will be located in the dust-containing boundary layer. A lower part of the angled strip faces towards the space and lies parallel with the cover plate in order to define the suction gap, thereby ensuring that its width remains constant in the direction of flow of the air. A suction gap formed in this way easily becomes clogged with dust after a relatively short time in operation and must therefore be cleaned at regular intervals. Another problem is that the web may be damaged by the front edge and flat cover plate, causing a break in the web. The problem is aggravated since the web is drawn by the air flow up towards the front edge of the cover plate. Said space in the hood is irregular in shape, with several corners and edges that detrimentally affect that air flow so that local whirls of air containing dust occur, the flow of the air towards the outlet gradually deteriorates and dust collects along the walls near said corners and edges, which in turn results in poorer suction effect so that the suction gap becomes more easily clogged by dust particles for this reason as well.

However, the problem of suction inlets and channels becoming clogged is general to all known apparatus for removing dust released during treatment of a moving web of fibre material. Installing nozzles inside the actual suction channel has been suggested so that air can be blown in the opposite direction through the gap at regular intervals, in order to remove collections of dust when the suction source has been disconnected. Such interruptions in operation are undesirable since dust is produced continuously and will be blown out into the surroundings, causing further deterioration of the working environment.

U.S. Pat. No. 5,466,298 discloses a dust suction system with upstream and downstream curved surfaces in a suction inlet opening which is directed vertically downwardly. Pressurized air is directed to the web and flows along the curved downstream wall of the suction inlet opening by the Coanda effect.

Accordingly, one object of the invention is to provide an improved apparatus for taking care of and removing the dust released during treatment of a moving web of fibre material, thereby achieving an improved working environment for the operating personnel.

SUMMARY OF THE INVENTION

The apparatus according to the invention is characterized in that the main part is shaped as or substantially as part of a cylinder to provide a corresponding curved inner side in the suction chamber; that the suction gap comprises an inwardly converging outer section that defines a gradual throttling, and an inwardly diverging inner section that defines a gradual enlargement, said sections merging at a transition where the throttling is maximal, said transition having a minimal extension seen in the flow direction of the air through the suction gap; that the first inlet forming part comprises a flat surface that defines the whole or most of its side of said enlargement; and that the second inlet forming part comprises both a curved surface having predetermined radius and such an arc length that it defines the whole of its side of the throttling and an initial part of the enlargement section, and also an inner, flat surface extending at a tangent from the curved surface and forming an acute angle a with a tangent to the curved surface at said transition.

BRIEF DESCRIPTION OF THE DRAWINGS

The invention will be described in more detail with reference to the accompanying drawings.

DETAILED DESCRIPTION OF THE PREFERRED EMBODIMENTS

Figure 1:
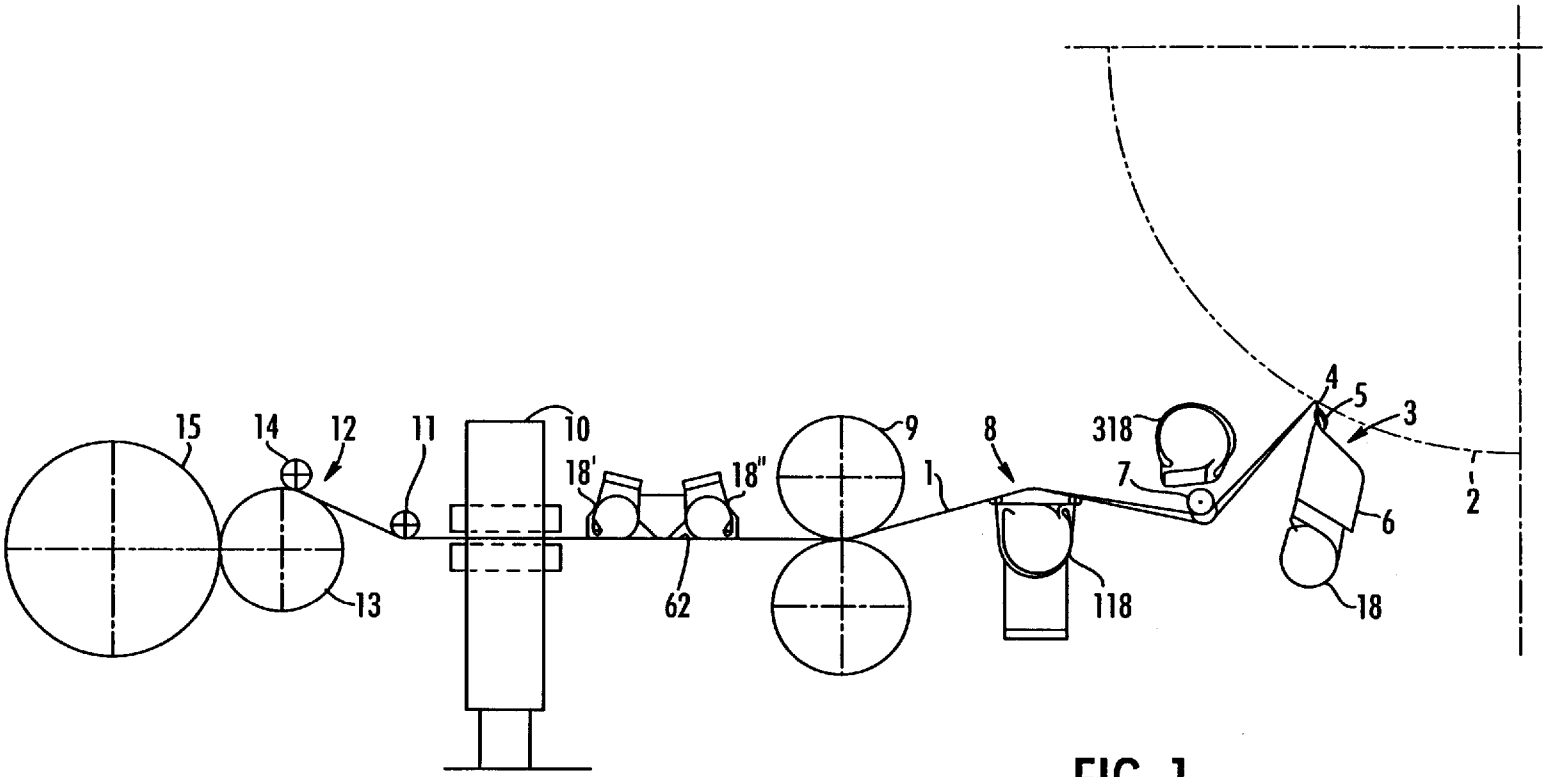
FIG. 1 is a schematic side view of a section between a Yankee cylinder and a reel-up in a soft crepe paper machine, said section being provided with a plurality of dust removal apparatus according to the invention.

At the dry end of a soft crepe paper machine shown schematically in FIG. 1, a paper web 1 adhering to the envelope surface of a Yankee cylinder 2, rotating counter-clockwise, is lead downwards to a creping doctor 3. There the paper web 1 is creped off the Yankee cylinder 2 by a creping blade 4 mounted in a holder 5 that extends substantially vertically up from a doctor beam 6. From the creping blade 4 the creped paper web 1 runs obliquely downwards and passes a first spreading means 7 in the form of a bow-shaped curved beam, and a second spreading means 8 which will be explained below in more detail, a calender 9, a grammage scanner 10 and a deflection roll 11 before arriving at a reel-up 12. In the embodiment shown the reel-up 12 comprises a drum reel-up with a supporting cylinder 13. An empty reeling drum 14 has just been lowered to abutment with the supporting cylinder 13, beside which a recently finished reel 15 of soft crepe paper is shown.

Dust is liberated from the paper web 1 during creping, and some of this dust will be entrained in a boundary layer on each side of the creped paper web 1 which is moving at high speed, while almost all the remaining dust will fall down towards the doctor beam 6. Dusty air will also flow out of the hood covering the Yankee cylinder when the paper web 1 runs out of the hood, this dust then falling down to the paper web. In order to take care of and remove at least a considerable part of the dust content in the boundary air layers and in the air in the spaces on both sides of the paper web 1, a plurality of dust removal apparatus are applied between the creping doctor and the grammage scanner 10. For the sake of clarity these dust removal apparatus are shown with the front end piece removed.

Figure 2:
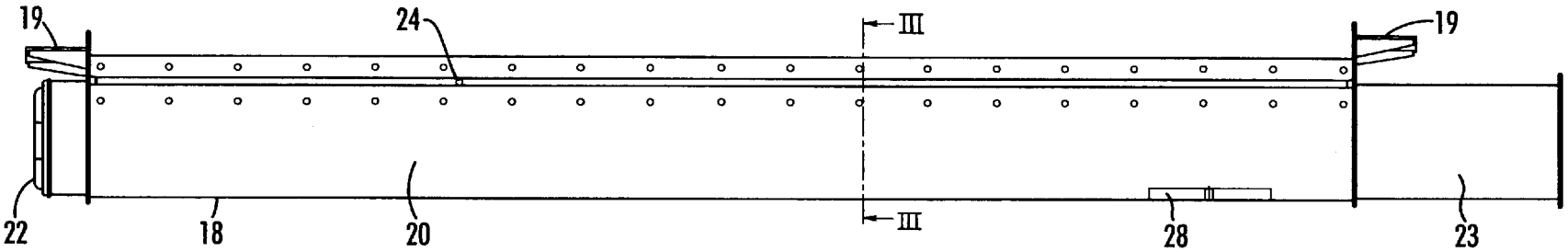
FIG. 2 is a side view of an apparatus according to a first preferred embodiment of the invention.
Figure 3:
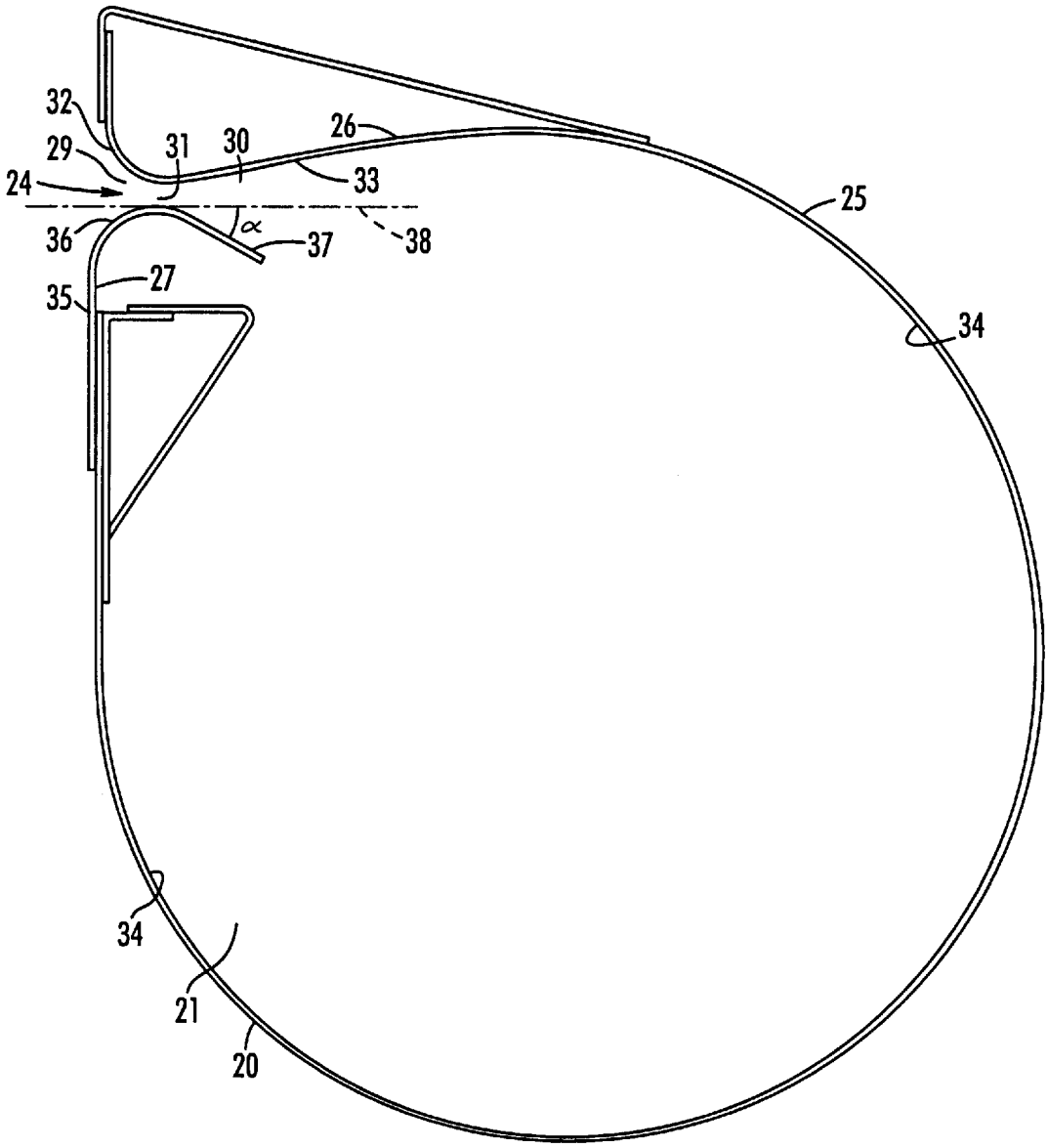
FIG. 3 is a cross section along the line III—III in FIG. 2.

FIG. 2 shows from the side an apparatus according to a first embodiment of the invention comprising a dust suction box 18 and attachment elements 19 for mounting the apparatus on the lower side of the doctor beam 6 of the creping doctor 3 to remove dust released when the soft crepe paper web 1 is creped off the Yankee cylinder 2. The dust suction box 18 comprises an elongated housing 20 having an inner suction chamber 21, see FIG. 3, closed at one end by an inspection hatch 22 and at the other end being in communication with a suction source (not shown) via a coaxial pipe socket 23 and a hose (not shown). The housing 20 has a web-wide inlet 24 in the form of a suction gap communicating directly with the suction chamber 21. The wall of the housing 20 includes a main part 25 in the form of a part of a cylinder, and first and second parts 26, 27 tangentially joining each end of the main part 25 and defining said inlet 24 in the form of a suction gap between them. A curved or cylindrical surface 34 is defined within the area for the main part 25 on its inner side, i.e. in the suction chamber 21. An inspection hatch 28 is arranged on the lower side of the housing in the vicinity of the outlet end.

The suction gap 24 comprises an inwardly converging outer section 29 that defines a gradual throttling, and an inwardly diverging inner section 30 that defines a gradual enlargement, said sections 29, 30 merging at a transition 31 where the throttling is maximal and the extension minimal seen in the flow direction of the air through the suction gap 24.

The first inlet forming part 26 has an outer curved or cylindrical surface 32 with predetermined radius, and an inner flat surface 33 merging tangentially into both the inner curved surface 34 of the main part 25 and the outer curved surface 32, the point of tangent in the latter case being located in the vicinity of the transition 31 to the enlargement 30.

The second inlet forming part 27 has an outer flat surface 35 which is located in a plane that is a tangent to the outer curved surface 32 of the first inlet forming part 26, and a curved or cylindrical surface 36 with predetermined radius, the outer flat surface 35 is a tangent to the curved surface 36. The curved surface 36 has such an arc length that it defines its side of the throttling 29 and an initial part of the enlargement 30, as well as the actual transition 31 therebetween. The second inlet forming part 27 also has an inner, flat surface 37 extending at a tangent from the curved surface 36 and forming an acute angle $\alpha$ with a tangent 38 to the curved surface 36 at said transition 31. Said angle $\alpha$ is 20°–50°, preferably 30°–40°. The radius of the curved surface 36 of the second inlet part 27 is preferably as large as or larger than the width of the suction gap 24 at said transition 31 (maximum throttling).

Figure 4:
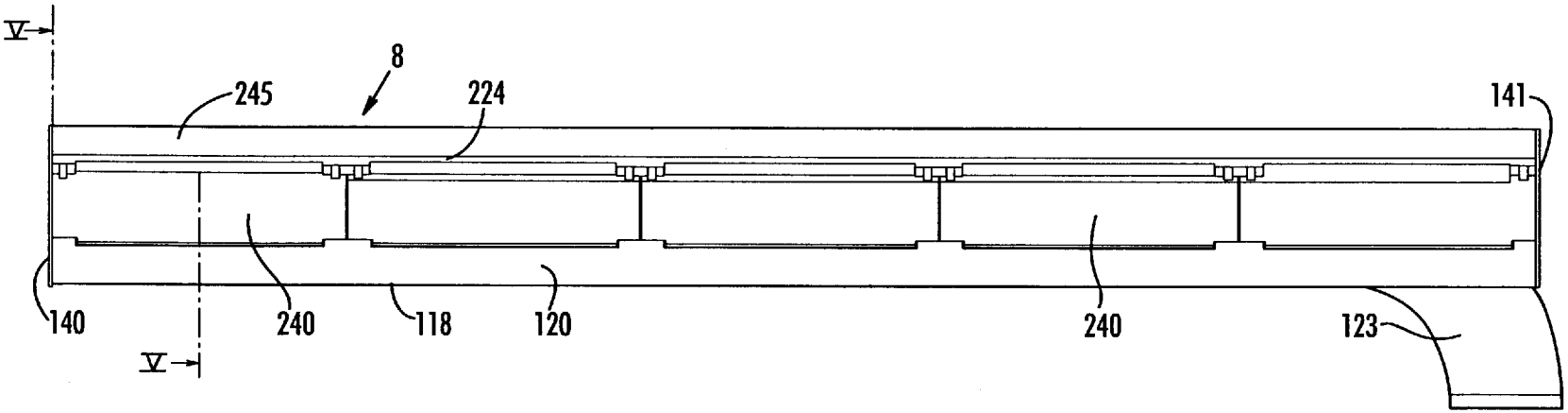
FIG. 4 is a side view of an apparatus according to a second preferred embodiment of the invention.

In FIG. 4 an apparatus according to a second embodiment of the invention is shown from the side. This apparatus comprises said second spreading means 8 and a dust suction box 118 for removing dust present in the air whirling in the spaces before and after the web spreading means 8. The apparatus comprises journalling means (not shown) by means of which it is pivotable and vertically adjustable so that the spreading means 8 can be adjusted in relation to the paper web. The dust suction box 118 comprises an elongated housing 120 having an inner suction chamber 121 provided at one end with a pipe socket 123 communicating with a suction source (not shown) via a hose (not shown). The housing 120 is closed at the ends by end pieces 140, 141. The housing 120 has a first web-wide inlet 124, see FIG. 5, in the form of a suction gap communicating directly with the suction chamber 121. The housing 120 includes a main part 125 having the form of a part of a cylinder, and first and second parts 126, 127, tangentially joining each end of the main part 125 and defining said suction gap formed inlet 124 between them. A curved or cylindrical surface 134 is formed within the area for the main part 125 on its inner side, i.e. in the suction chamber 121.

The suction gap 124 comprises an inwardly converging outer section 129 that defines a gradual throttling, and an inwardly diverging inner section 130 that defines a gradual enlargement, said sections 129, 130 merging at a transition 131 where the throttling is maximal, said transition having a minimal extension seen in the flow direction of the air through the suction gap 124.

The first inlet forming part 126 comprises a flat surface 133 that merges tangentially with the internal curved surface 134 of the main part 125.

The second inlet forming part 127 has an outer flat surface 135 and a curved or cylindrical surface 136 having predetermined radius, the outer flat surface 135 being a tangent to the curved surface 136. The curved surface 136 has such an arc length that it defines its side of the throttling 129 and an initial part of the enlargement 130 as well as the actual transition 131 therebetween. Furthermore, the second inlet forming part 127 has an inner flat surface 137 extending at a tangent from the curved surface 136 and forming an acute angle a with a tangent 138 to the curved surface 136 at said transition 131. Said angle $\alpha$ is 20°–50°, preferably 30°–40°. The radius of the curved surface 136 of the second inlet part 127 is as large as or larger than the width of the suction gap 124 at the transition 131 (maximum throttling).

The housing 120 is also provided with a second inlet 224 divided into several parts separated by partitions 253 in the wall of the housing. Each such part of the inlet has first and second inlet parts 226, 227 defining the inlet 224 between them in the form of a suction gap. The second inlet part 227 is preferably supported by a wall 240 in the shape of a cylinder arc hinged to the main part 125 and situated outside the circle arc described by the main part 125.

The suction gap 224 comprises an inwardly converging outer section 229 that defines a gradual throttling, and an inwardly diverging inner section 230 that defines a gradual enlargement, said sections 229, 230 merging at a transition 231 where the throttling is maximal, said transition having a minimal extension seen in the flow direction of the air through the suction gap 224. The first inlet forming part 226 has a flat surface 233 directed radially in relation to the inner curved surface 134 of the main part 125.

The second inlet forming part 227 has an outer flat surface 235 and a curved or cylindrical surface 236 with predetermined radius, the outer flat surface 235 is a tangent to the curved surface 236. The curved surface 236 has such an arc length that it defines its side of the throttling 229 and also the whole of the enlargement 230, as well as the actual transition 231 therebetween. To achieve the best function it is important that the radius of the curved surface 236 of the second inlet part 227 is as large as or larger than the width of the suction gap 224 at the transition 231 (maximum throttling).

Following the enlargement 230 is an inlet channel 241 of constant cross section, which opens in an opening 242 in the main part 125, said opening being defined in axial direction by said partitions 253. The inlet channel 241 is defined by inner surfaces 243, 244 of the inlet parts 226, 227.

Said spreading means 8, termed as a shoe, comprises a tube 245 situated upstream and a tube 246 situated downstream. The tubes are curved in a bow-shape in the same way as the conventional spreading bar 7 and face away from each other so that the greatest distance between them is at the middle and the shortest distance at their ends. The tubes are also oriented in relation to each other so that a flat plane 249 intersecting the curved centre line of the one tube 245 also intersects the curved centre line of the other tube 246. The two tubes are supported by a common, flat, stable bottom plate 247 that is a tangent to the main part 125 of the dust suction box and welded thereto. The spreading shoe 8, which is symmetrical, also comprises an upper arched support plate 248 welded to the tubes 245, 246, the support plate 248 thus being in connection tangentially with the tubes, seen in each cross section thereof. The arched support plate comprises an inclined part 250 located upstream and an inclined part 251 located downstream and a top transition 252 between them, which is curved. Since the tubes 245, 246 are situated in one and the same plane 249 with regard to their centre lines, as described above, the parts 250, 251 sloping in the direction of travel of the web will also slope from the middle out towards the edges, i.e. transversely to the direction of travel of the web, depending on the curvature of the tubes 245, 246, the transverse slope being greatest at the tubes 245, 246 and decreasing gradually to zero in the direction of the top transition 252. The inclination is suitably such that the support parts 250, 251 encompass an obtuse angle in the range of 150°–170°. The upper side of the support plate forms a sliding surface for the paper web 1 to run over. The paper web is effectively spread since the spreading occurs during a long distance in the direction of travel of the web corresponding to the width of the spreading shoe 8.

Figure 5:
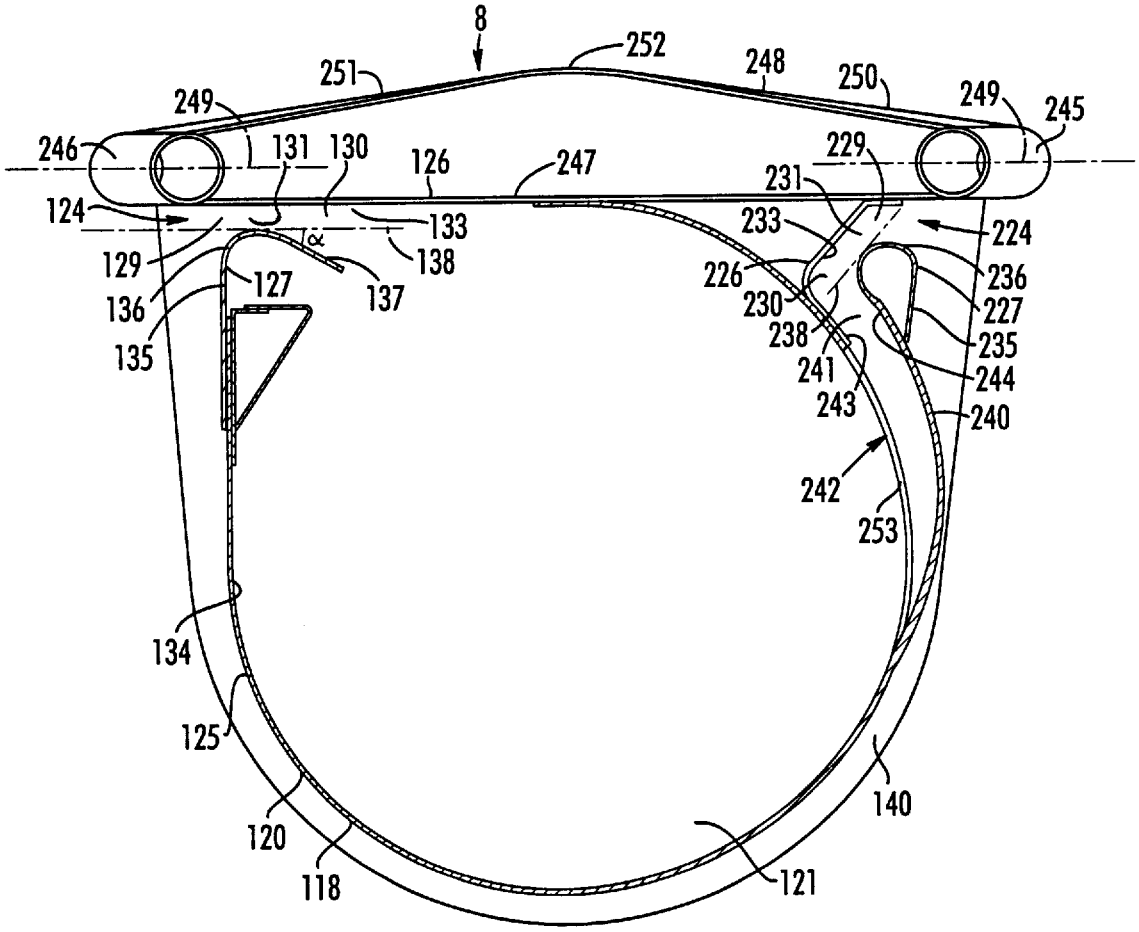
FIG. 5 is a cross section along the line V—V in FIG. 4.

As can be seen in FIG. 5, part of the bottom plate 247 forms the first inlet part 126 of the housing 120, the inlet part thus being extended to the tube 246, the curved surface of which has a favorable effect on the process of flow of air towards the suction gap 124. At the second inlet gap 224, the first inlet part 226 extends from the bottom plate 247 at an angle of 45°.

Figure 6:
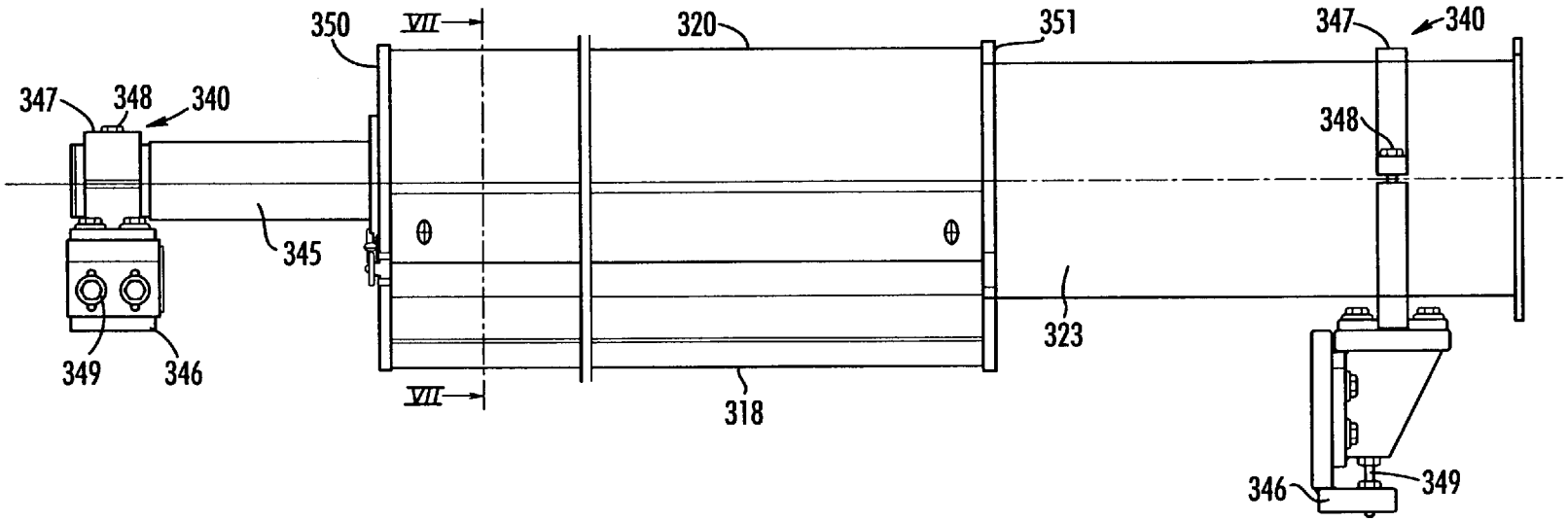
FIG. 6 is a side view of an apparatus according to a third preferred embodiment of the invention.

FIG. 6 is a view from the side of an apparatus according to a third embodiment of the invention comprising journalling means 340 and a dust suction box 318 for removing dust from the air whirling in the spaces before and after the conventional spreading bar 7 above which this apparatus is mounted, as can be seen in FIG. 1. The dust suction box 318 comprises an elongated housing 320 having an inner suction chamber 321, see FIG. 7, that communicates with a suction source (not shown) via a coaxial pipe socket 323. The housing is otherwise closed at the ends by end pieces 350, 351. The housing 320 has a first web-wide inlet 324, in the form of a suction gap communicating with the suction chamber 321. The housing 320 includes a main part 325 substantially in the form of a part of a cylinder, and first and second parts 326, 327 defining said suction gap inlet 324 between them. Curved or cylinder arc formed surfaces 334*a*, 334*b*, are formed within the area for the main part 325 on its inner side, i.e. in the suction chamber 321.

The suction gap 324 comprises an inwardly converging outer section 329 that defines a gradual throttling, and an inwardly diverging inner section 330 that defines a gradual enlargement, said sections 329, 330 merging at a transition 331 where the throttling is maximal, said transition having a minimal extension seen in the flow direction of the air through the suction gap 324.

The first inlet forming part 326 comprises a reinforcing pipe 342 and a separate inner plate 343 having a free inner edge 344. The inlet part 326 has an outer surface 332, curved or in the form of a cylinder arc with predetermined radius, and an inner flat surface 333 that merges tangentially with the coaxial pipe socket 323 and the outer curved surface 332.

Figure 7:
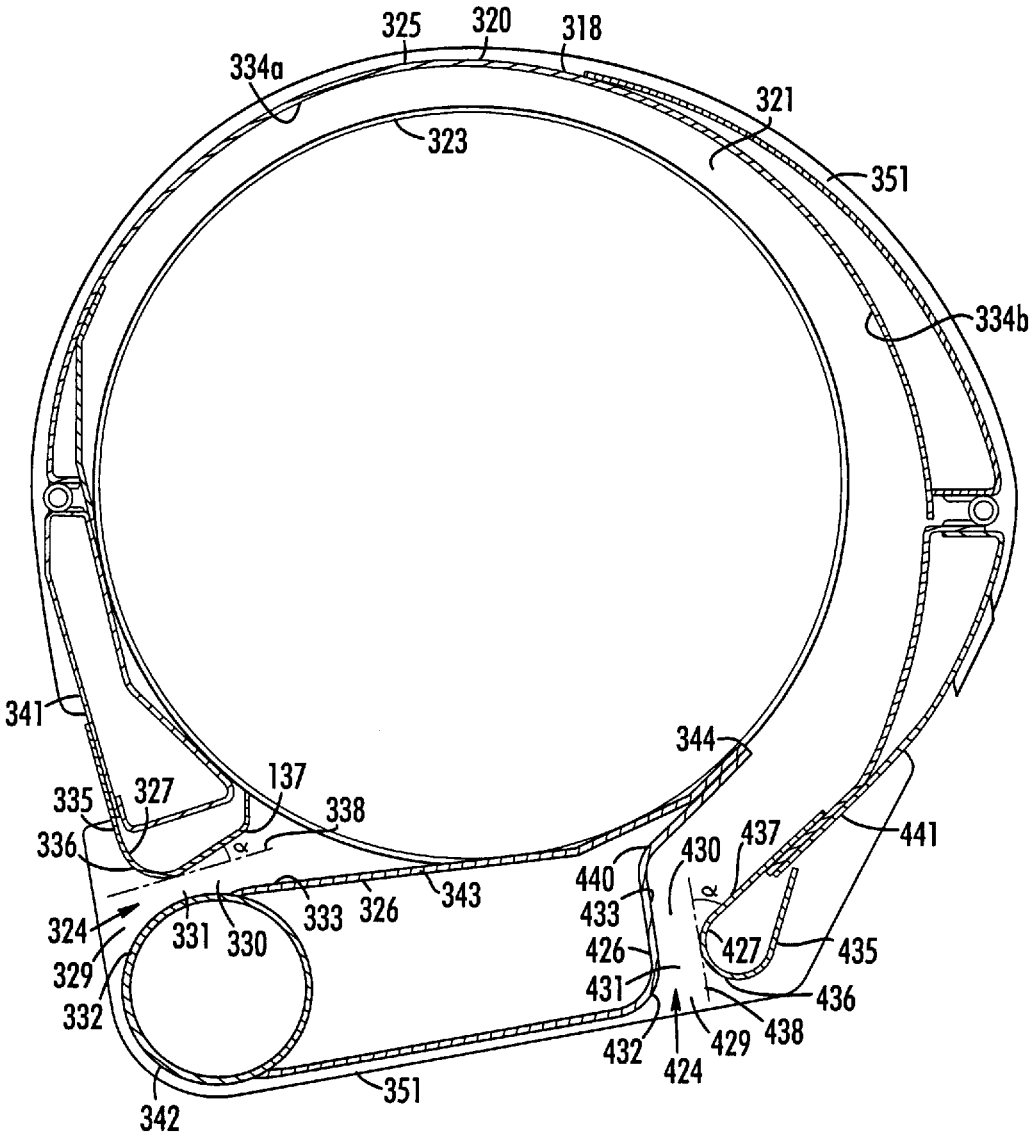
FIG. 7 is a cross section along the line VII—VII in FIG. 6.

The second inlet forming part 327 has a part 341 hinged to the main part 325 which enables the inlet part 327 to also function as an inspection hatch, thereby allowing access to the suction chamber 321 in open position. As can be seen in FIG. 7, the inlet part 327 has an outer flat surface 335 and a curved or cylindrical surface 336 having predetermined radius, the outer flat surface 335 being tangent to the curved surface 336. The curved surface 336 has such an arc length that it defines its side of the throttling 329 and an initial part of the enlargement 330 as well as the actual transition 331 therebetween. Furthermore, the second inlet part 327 has an inner flat surface 337 extending at a tangent from the curved surface 336 and forming an acute angle $\alpha$ with a tangent 338 to the curved surface 336 at said transition 331. Said angle $\alpha$ is 20°–50°, preferably 30°–40°. The radius of the curved surface 336 of the second inlet part 327 is preferably as large as or larger than the width of the suction gap 324 at the transition 331 (maximum throttling).

The housing 320 is also provided with a second inlet 424. For this purpose the housing is provided with an additional set of first and second parts 426, 427 defining the inlet 424 between them in the form of a suction gap. The first inlet part 426 is formed by a profile plate 440 secured to the above-mentioned inner plate 343 at its inner edge 344 and to the above-mentioned reinforcing pipe 342. The second inlet part 427 comprises a part 441 hinged to the main part 325 enabling the inlet part 427 to function also as an inspection hatch providing access to the suction chamber 321 when in open position.

The suction gap 424 comprises an inwardly converging outer section 429 that defines a gradual throttling, and an inwardly diverging inner section 430 that defines a gradual enlargement, said sections 429, 430 merging at a transition 431 where the throttling is maximal, said transition having a minimal extension seen in the flow direction of the air through the suction gap 424.

The first inlet forming part 426 has a surface 432, curved or in the shape of a cylinder arc with predetermined radius, and an inner flat surface 433 directed substantially radially in relation to the inner curved surface 334 of the main part 325 and merging tangentially into the outer curved surface 432, the point of tangent being situated at the transition 431 to the enlargement 430.

The second inlet forming part 427 has an outer flat surface 435 and a curved or cylinder arc formed surface 436 with predetermined radius, the outer flat surface 435 being a tangent to the curved surface 436. The curved surface 436 has such an arc length that it defines its side of the throttling 429 and also a part of the enlargement 430, as well as the actual transition 431 between them. Furthermore, the second inlet part 427 has an inner, flat surface 437 extending at a tangent from the curved surface 436 and forming an acute angle $\alpha$ with a tangent 438 to the curved surface 436 at said transition 431. Said angle $\alpha$ is 20°—50°, preferably 30°–40°. The radius of the curved surface 436 of the second inlet part 427 is preferably as large as or larger than the width of the suction gap 424 at the transition 431 (maximum throttling).

Said journalling means comprise a shaft extension 345 and said pipe socket 323, which also functions as a shaft extension. The shaft extensions 345, 323 rest on stands 346 via holders 347. The apparatus is fixed in a desired operating position with regard to the angle of the inlets 224 and 324 in relation to the spreading bar 7 by means of first screw elements 348. The apparatus is set in a desired operating position with regard to its level above the spreading bar 7 by means of second screw elements 349.

Figure 8:
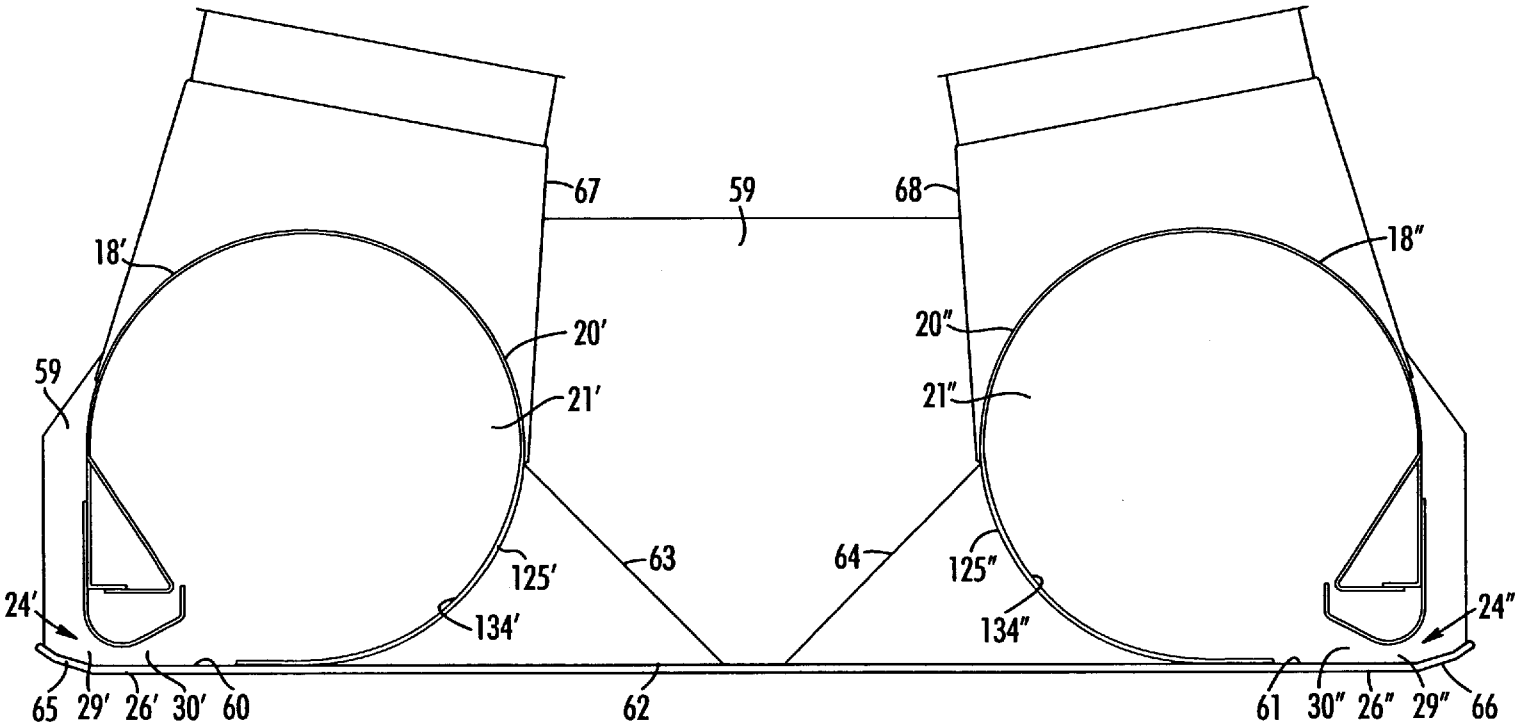
FIG. 8 is a through-section of an apparatus according to a fourth preferred embodiment of the invention.

FIG. 8 shows a through-section of an apparatus according to a fourth embodiment of the invention comprising two suction boxes 18', 18" of substantially the same design as that according to FIG. 2 with the exception of the design of the first inlet part 26', 26", in that the outer curved surface 32 and the inner flat surface 33 are replaced by a flat surface 60 and 61, respectively, merging tangentially into the internal curved surface 134', 134" of the main part 125', 125 " and defining its side of the throttling 29', 29" and enlargement 30', 30". The apparatus also comprises an unperforated web-wide cover plate 62 to which the dust suction boxes are secured at a distance from each other and mirrored so that the inlets 24', 24" face away from each other. Inclined reinforcement plates 63, 64 are secured to respective dust suction boxes and the cover plate 62. The cover plate 62 is flat except at its end parts 65, 66 situated downstream and upstream, these being bent away from the paper web 1 and located outside each inlet. The part of the cover plate 62 inside each end part 65, 66 forms the first inlet part 26', 26" of the housing 20', 20" which, on its inner side has said flat surfaces 60, 61. Each dust suction box has two pipe sockets 67, 68 arranged on the main part of the housing at a distance from the inlet and communicating with a suction source (not shown). The pipe sockets 67, 68 replace the end outlet 23 according to FIG. 2. Arranging bent end parts 65, 66 situated downstream and upstream prevents the paper web from coming into contact with the edges of the cover plate 62. This is particularly important if the paper web arrives at the apparatus and leaves it in a run that in both cases forms a small angle with the plane of the cover plate 62. An end plate 59 closes one of the ends of each suction chamber 21', 21".

The inlet parts are preferably arranged at any of the described inlets and movable in relation to each other in order to control the size of the maximum throttling at said transition depending on each particular operation, suitably within the interval 10–30 mm, preferably 0.5–1 inch (12.7–25.4 mm). The suction gap 324 situated downstream in the embodiment according to FIG. 7 may also be arranged to be completely closed. In all cases it is preferably the second inlet part 27, etc., that can be displaced and locked in the desired position, while the first inlet part 26, etc., is stationary.

Designing the dust suction box in accordance with the present invention enables the dust to be efficiently removed with increased operating reliability and improved working environment. The geometry of the passages through which the dust-carrying air passes results in considerably less risk of dust adhering to the walls than with known constructions. The valuable improvement of removing the dust from the areas surrounding the paper web is advantageously achieved by one or more of several cooperating features. One feature resides in the design of the suction gap with an initial throttling to cause gradually increasing speed that culminates in the short transition to the subsequent expansion of the air with maximum throttling so that the dust is entrained with the increasing speed of the air flow through the suction gap. The dust does not therefore have sufficient time to become adhered to the walls.

Another feature is the curved surfaces of the throttling. The air endeavors to follow these curved surfaces while forming a thin layer of air resulting in a higher speed than the air outside said layer of air, so that the dust particles have even less time to become adhered to the curved surfaces. A further feature is the cylindrical inner surface of the suction chamber which causes the air to be guided toward this and round in a spiral or rotary process towards the outlet or outlets, without disturbing local whirl formations which might allow the dust particles time to become adhered to the walls.

It is also a considerable advantage that the principle according to the invention for designing the dust suction box can be used for all dust suction boxes installed at various points between a Yankee cylinder and a reel-up.

The invention is described in connection with the removal of dust released during the manufacture of a soft crepe paper web which is creped off a Yankee cylinder, but may of course be used for other moving webs of fibre material where dust is released during various types of treatment, such as in machines for cutting and re-winding paper webs, in printing machines and in the dry end of paper machines of types other than those specifically described above.

That which is claimed is:

1. An apparatus for removing dust released during the treatment of a moving web of fibre material, said apparatus comprising:

a source of suction; and a dust suction box extending across the width of the web and in fluid communication with said suction source, said suction box including;

a main part having an interior surface which defines at least part of a cylinder; and first and second parts defining opposite first and second sides of a suction gap, said suction gap comprising an upstream converging throttling section adjacent the web and a downstream diverging section which enlarges towards the interior of said main part such that said suction gap has a predetermined minimum width at a transition between said converging and diverging sections, said first part having a flat surface which defines at least a substantial part of the diverging section of said first side of the suction gap, and said second part having a curved surface with a predetermined radius of curvature and arc length which defines the converging section and part of the diverging section of said second side of the suction gap, said second part further having a flat surface extending from said curved surface in said diverging section and defining an acute angle relative to a line tangent to said curved surface at said transition.

2. An apparatus as claimed in claim 1 wherein said acute angle is between about 20° and 50°.

3. An apparatus as claimed in claim 2 wherein said acute angle is between about 30° and 40°.

4. An apparatus as claimed in claim 1 wherein the radius of said curved surface of said second part is at least as large as the width of said suction gap at said transition.

5. An apparatus as claimed in claim 1 wherein said first and second parts are movable in relation to each other to allow closure and control of the size of the minimum width of the suction gap.

6. An apparatus as claimed in claim 5 wherein the size of the minimum width is adjustable within a range of 10–30 mm.

7. An apparatus as claimed in claim 6 wherein the size of the minimum width is adjustable within a range of 12.7–25.4 mm.

8. An apparatus as claimed in claim 1 wherein said flat surface of said first part merges tangentially into the cylindrical interior surface of said main part.

9. An apparatus as claimed in claim 1 wherein said flat surface of said first part is parallel to a line tangent to said curved surface of said second part at said transition.

10. An apparatus as claimed in claim 1 wherein said first part further has a curved surface with an arc length which defines the converging section and part of the diverging section of said first side of the suction gap and which merges tangentially into said flat surface of first part.

11. An apparatus as claimed in claim 1 wherein said flat surface of first part also defines at least part of the converging section of the first side of the suction gap.

12. An apparatus as claimed in claim 1 further comprising attachment elements for mounting said duct suction box to a doctor beam.

13. An apparatus as claimed in claim 1 further comprising a cover plate having a flat surface along which the web is intended to travel and end parts situated upstream and downstream of the flat surface, said end parts being angled away from said flat surface so that the web runs free from the upstream and downstream end parts, and said dust suction box being secured to the cover plate with said suction gap being positioned adjacent to said cover plate.

14. An apparatus as claimed in claim 13, further comprising a second dust suction box secured to the cover plate in a mirror relationship to the first dust suction box such that the respective suction gaps face away from each other relative to the direction of travel of the web.

15. An apparatus as claimed in claim 13 wherein said first part of said dust suction box is defined by said cover plate.

16. An apparatus as claimed in claim 1 further comprising a second dust suction box spaced from said first dust suction box in the direction of web travel.

17. An apparatus for spreading a web of creped paper and removing dust released therefrom, said apparatus comprising:

a) a web spreader in the form of a symmetrical shoe comprising;

an upstream tubular shaped member having a central bend and lying in a plane;

a downstream tubular shaped member having a central bend opposite said upstream tubular shaped member and lying in the same plane as said upstream tubular shaped member;

a bottom plate attached to each of said tubular shaped members; and an arched support plate secured to said tubular shaped members opposite said bottom plate and having an outer surface over which the web is intended to slide, said arched support plate comprising an inclined upstream part, an inclined downstream part and a curved top transition therebetween;

b) a source of suction; and c) a dust suction box secured to said bottom plate of said web spreader and in fluid communication with said suction source, said suction box including;

a main part having an interior surface which defines at least part of a cylinder; and first and second parts defining opposite first and second sides of a suction gap, said suction gap comprising an upstream converging throttling section adjacent the web and a downstream diverging section which enlarges towards the interior of said main part such that said suction gap has a predetermined minimum width at a transition between said converging and diverging sections.

18. An apparatus as claimed in claim 17 wherein said inclined upstream and downstream parts of said arched support plate define an included obtuse angle of between 150° and 170°.

19. An apparatus as claimed in claim 17 wherein said first part of said dust suction box is defined by said bottom plate.

20. An apparatus as claimed in claim 17 said apparatus is pivotably and vertically movably journalled for adjustment of the web spreader in relation to the web.

21. An apparatus as claimed in claim 17 wherein, said first part has a flat surface which defines at least a substantial part of the diverging section of said first side of the suction gap, and said second part has a curved surface with a predetermined radius of curvature and arc length which defines the converging section and part of the diverging section of said second side of the suction gap, said second part further having a flat surface extending from said curved surface in said diverging section and defining an acute angle relative to a line tangent to said curved surface at said transition.

22. An apparatus as claimed in claim 21 wherein said acute angle is between about 20° and 50°.

23. An apparatus as claimed in claim 22 wherein said acute angle is between about 30° and 40°.

24. An apparatus as claimed in claim 21 wherein the radius of said curved surface of said second part is at least as large as the width of said suction gap at said transition.

25. An apparatus as claimed in claim 17 wherein said dust suction box further comprises a second suction gap adjacent the bottom plate and positioned at the opposite side of the dust suction box in relation to the first suction gap.

* * * * *